US006164761A

United States Patent [19]

Numata

[11] Patent Number: 6,164,761

[45] Date of Patent: Dec. 26, 2000

[54] SHEET ADHERING CONVEYING APPARATUS AND RECORDING APPARATUS

[75] Inventor: Yasuhiro Numata, Kawasaki, Japan

[73] Assignee: Canon Kabushiki Kaisha, Tokyo, Japan

[21] Appl. No.: 09/399,815

[22] Filed: Sep. 21, 1999

[30] Foreign Application Priority Data

Sep. 22, 1998 [JP] Japan ..... 10-267826

[51] Int. Cl.[7] ..... B41J 2/06

[52] U.S. Cl. ..... 347/55; 347/104

[58] Field of Search ..... 347/101, 104, 347/106, 55, 4

[56] References Cited

U.S. PATENT DOCUMENTS

| | | | |
|---|---|---|---|
| 4,704,621 | 11/1987 | van Cooten et al. | 347/55 |
| 4,855,768 | 8/1989 | Iino et al. | 347/55 |
| 5,781,218 | 7/1998 | Wakahara et al. | 347/55 |
| 6,030,070 | 2/2000 | Bern et al. | 347/55 |

*Primary Examiner*—Eugene Eickholt
*Attorney, Agent, or Firm*—Fitzpatrick, Cella, Harper & Scinto

[57] ABSTRACT

The present invention relates to a sheet adhering conveying apparatus comprising a conveyance belt for holding and feeding a sheet, with a plurality of electrodes embedded in the conveyance belt, each electrode having a voltage receiving portion formed to project above a surface of the conveyance belt and a voltage supply for supplying a voltage to the voltage receiving portions of the electrodes.

11 Claims, 7 Drawing Sheets

SHEET ADHERING CONVEYING APPARATUS AND RECORDING APPARATUS

BACKGROUND OF THE INVENTION

1. Field of the Invention

This invention relates to a conveying apparatus which conveys a sheet material by using electrostatic adherence and to a recording apparatus to which the conveying apparatus is mounted.

2. Description of Related Art

As for an inkjet recording apparatus, it is conventionally known that a full-line recording head is used to make it possible to produce high-speed and high-quality recording. Where the recording sheet material is conveyed to that recording head, conductive electrodes are laid in a form of comb-like shape in a conveyance belt, and the comb-shaped conductive electrodes are charged in order to produce static electricity, thereby adhering the recording sheet to convey the sheet.

FIGS. 7(*a*) and 7(*b*) are cross-sectional illustrations of essential portions showing a structure of a voltage receiving portion in a comb-shaped electrode embedded in a conveyance belt of a conventional adhering conveying apparatus. The conveyance belt 51 has comb-shaped electrodes 52 consisting of a conductive metal built-in. Under the comb-shaped electrodes 52, a base layer 51*a* is formed, and above the comb-shaped electrodes 52, a surface layer 51*b* is formed.

The comb-shaped electrodes 52 are electrically connected to a voltage receiving portion 54 which can be contacted with a voltage supplying brush 53 for supplying voltage to the comb-shaped electrodes 52, and the upper surface 54*a* of the voltage receiving portion 54 is constructed on the same level as the level of the surface layer 51*b* of the conveyance belt 51.

However, according to the conventional apparatus mentioned above, when the ink droplets 55 sprayed from the inkjet recording head, not shown, are scattered over the voltage receiving portion 54 as illustrated in FIG. 7(*b*) or when ink droplets 55 scattered over the conveyance belt 51 are flowing and moving to the voltage receiving portion 54, the ink droplets 55 remain on the voltage receiving portion 54 without being removed from the upper surface 54*a* of the voltage receiving portion 54 and thereby raise problems to the supplying of voltage from the voltage supplying brush 53 or cause the voltage receiving portion 54 or the voltage supplying brush 53 to be corroded, because the upper surface 54*a* of the voltage receiving portion 54 is on the same level as the level of the surface layer 51*b* of the conveyance belt 51. Also, there was a problem where the voltage supplying brush 53 had stains or was worn out quickly due to the fact that the voltage supplying brush 53 was also in contact with the surface of the conveyance belt 51.

This invention is intended to solve the problem above. It is an object of the invention to provide a sheet adhering conveying apparatus and a recording apparatus in which ink droplets can be removed easily from the voltage receiving portion and in which stains and wearing on the voltage receiving portion can be reduced even when the ink droplets sprayed from the inkjet recording head are scattered on the voltage receiving portions of the comb-shaped electrodes or when the ink droplets scattered over the conveyance belt are flowing and moving over the voltage receiving portion.

SUMMARY OF THE INVENTION

According to this invention to accomplish the object above, the sheet adhering conveying apparatus includes a conveyance belt for holding and conveying the sheet; a plurality of electrodes embedded in the conveyance belt having the voltage receiving portion projecting to the surface of the conveyance belt; and a voltage supplying means for supplying to the voltage receiving portion of the electrodes above.

According to the structure mentioned above, because the voltage receiving portion is projecting from the surface of the conveying sheet, a recording material, for example, ink droplets, may not spread over the voltage receiving portion of the electrodes upon flowing over the conveyance belt, and the apparatus can prevent the voltage supply from having a problem, such as blocking the contact between a voltage supplying means and electrodes or a rust and a corrosion of the voltage receiving portion, from occurring due to attachment of ink droplets to the voltage supplying portion.

As for the sheet adhering conveying apparatus, the electrode consists of a first electrode and a second electrode in the form of a rectangular strip shape to which electrical potential different from each other is applied, and the plurality of the first and second electrodes are arranged alternately in a comb-like shape along a direction intersecting with the moving direction of the conveyance belt.

In the sheet adhering conveying apparatus of the invention, the surface of the voltage receiving portion of the mentioned electrodes can be made of either an upwardly convex surface or an inclined plane. According to the structure above, when recording material, for example ink droplets, is spread over the voltage receiving portion, the ink flows over the inclined plane formed on the surface of the voltage receiving portion, and the recording material is automatically removed from the voltage receiving portion, resulting in having a good effect in terms of voltage supplying ability and corrosion resistance.

Further, the voltage supplying portion in the sheet adhering conveying apparatus is able to have a form fitted with the form of the voltage receiving portion of the electrodes. This structure makes it possible to secure the contacting area of a voltage supplying means with the voltage receiving portion, ensuring the apparatus to supply. As a means for supplying voltage, a voltage supplying brush can be used.

By adding a recording means to the mentioned sheet adhering conveying apparatus, this invention can constitute a recording apparatus having the same operation and effect as mentioned above. The recording means here may have a structure that the jumping droplets of ink are sprayed from the orifices to record on a recording material. The recording means may have a structure such that plural recording means are placed in the moving direction of the mentioned conveyance belt and those orifices are arranged in a direction intersecting with a moving direction of the conveyance belt at a right angle with the mentioned conveyance belt. Furthermore, the recording means can be a full-line recording head where a plurality of recording elements are placed over the whole width of a recording area of the sheet. The recording means can be a recording means that ink can be sprayed from the orifices utilizing film boiling occurring in the ink by application of thermal energy applied by the electric thermal converter.

DETAILED DESCRIPTION OF THE PREFERRED EMBODIMENT

Figure 1:
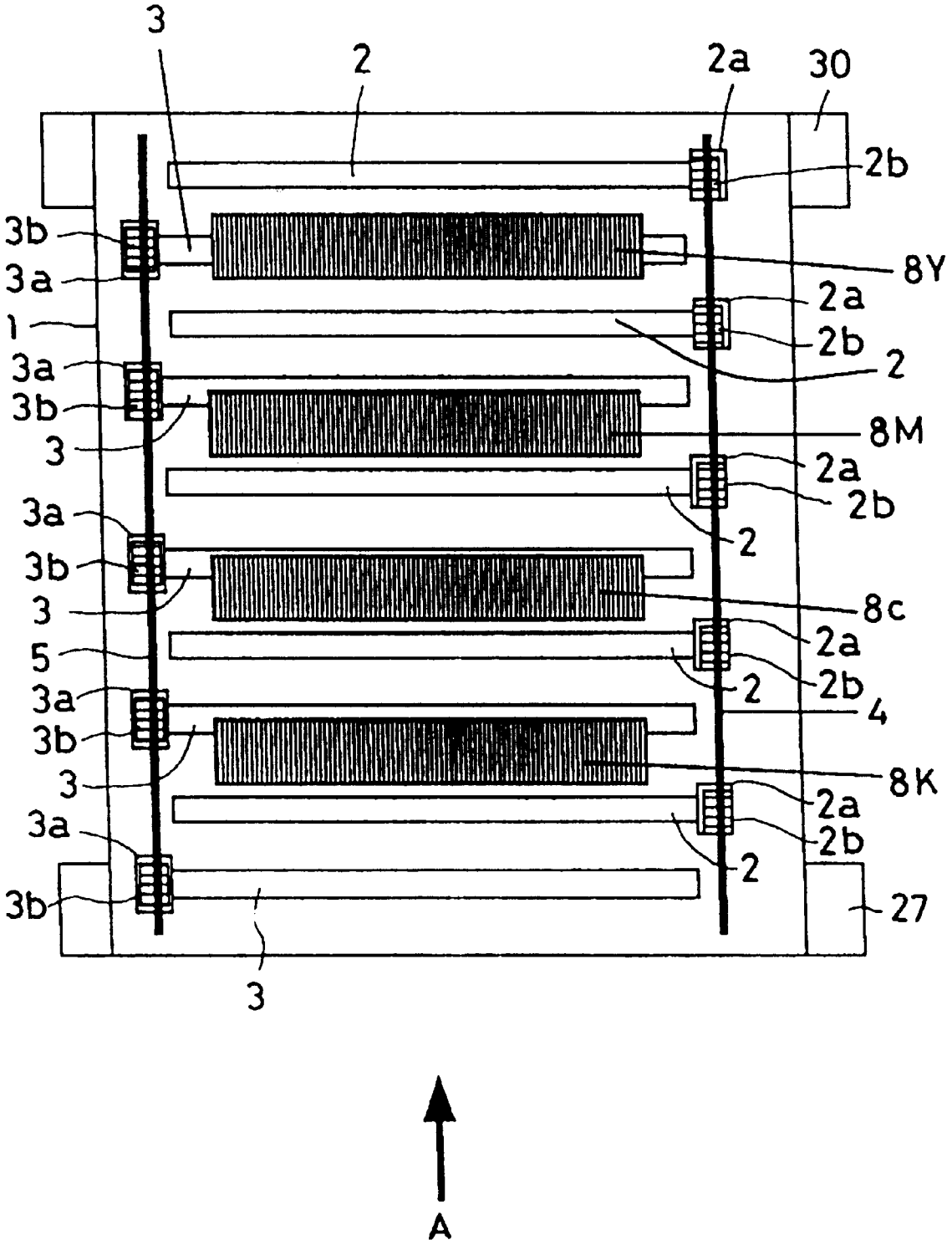
FIG. 1 is a plan view showing a structure of the sheet adhering conveying apparatus according to the present invention.

Referring to the drawings, an embodiment of the inkjet recording apparatus is concretely illustrated to which the sheet adhering conveying apparatus of the present invention and the recording apparatus having the conveying apparatus of the invention apply.

Figure 2:
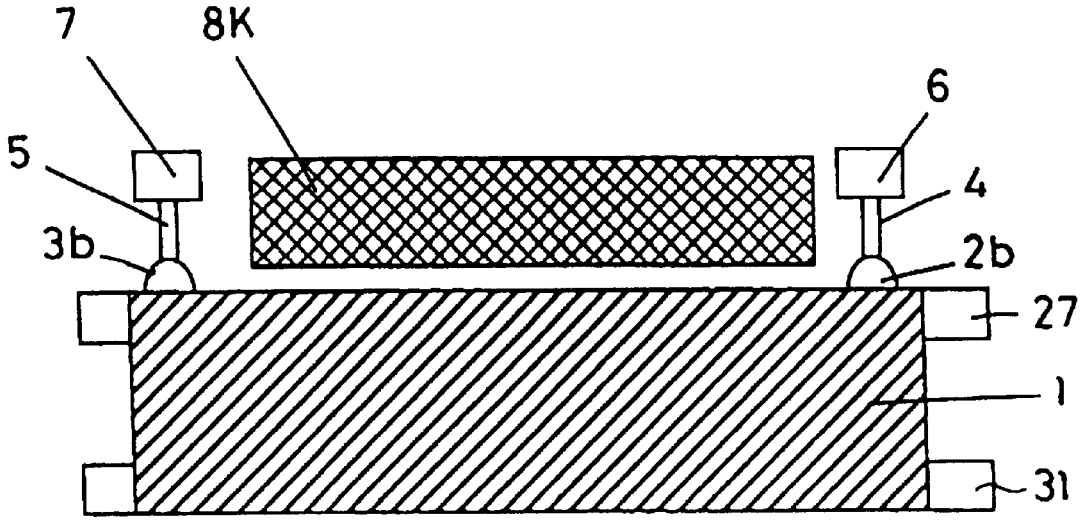
FIG. 2 is a view from the direction of A in FIG. 1.
Figure 3:
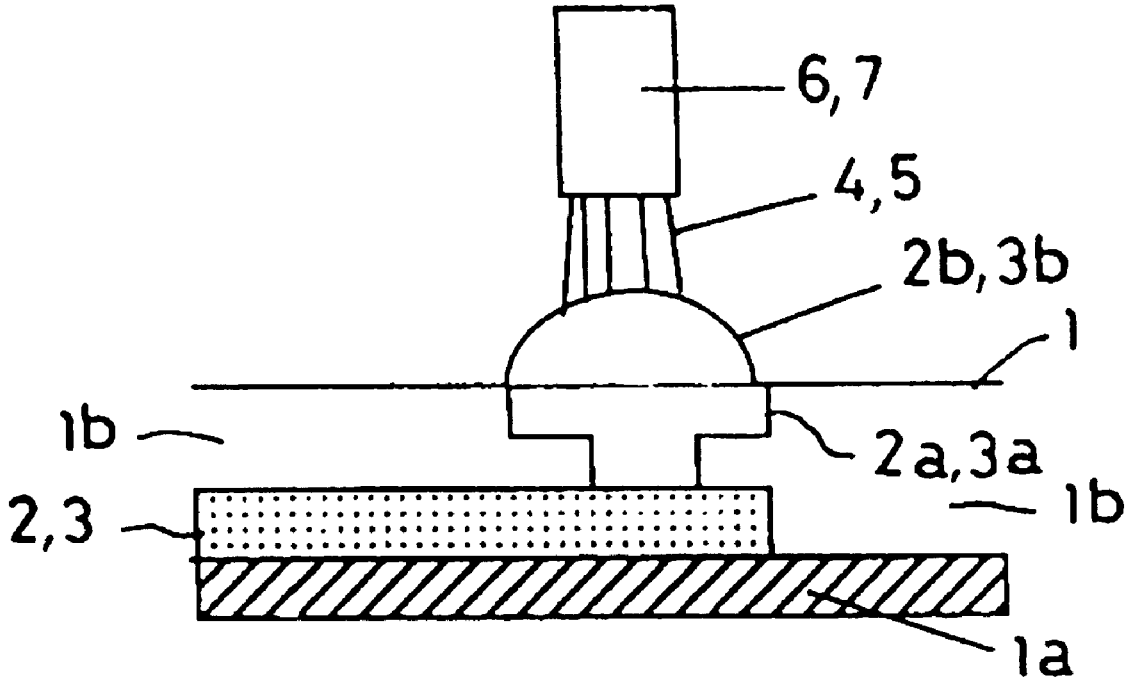
FIG. 3 is a view showing an essential portion of a structure of voltage receiving portions in the first embodiment of the sheet adhering conveying apparatus according to this invention.
Figure 4:
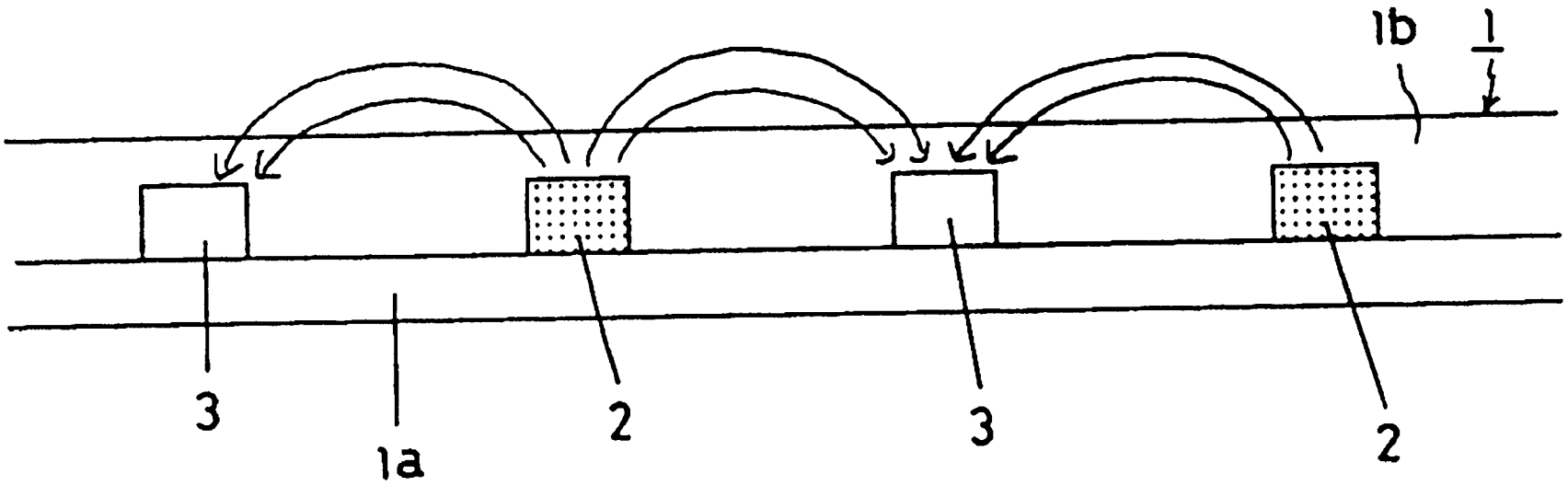
FIG. 4 is an illustration showing a situation of forming electrostatically adhering force produced between a pair of comb-shaped electrodes placed alternately to which the electrical potential difference from each other applies.
Figure 5:
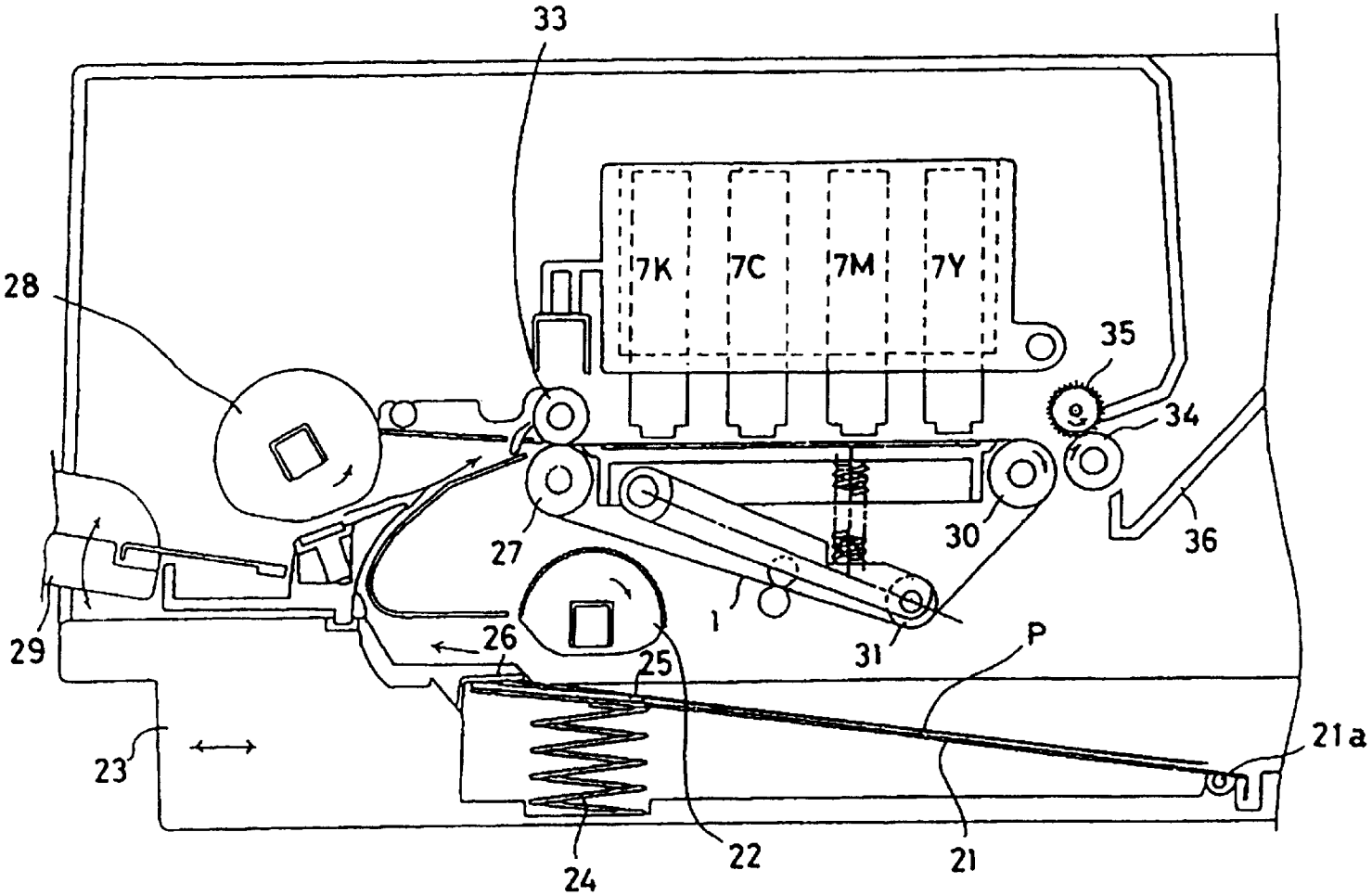
FIG. 5 is a cross-sectional view showing a structure of the recording apparatus employing the sheet adhering conveying apparatus according to the present invention.
Figure 6:
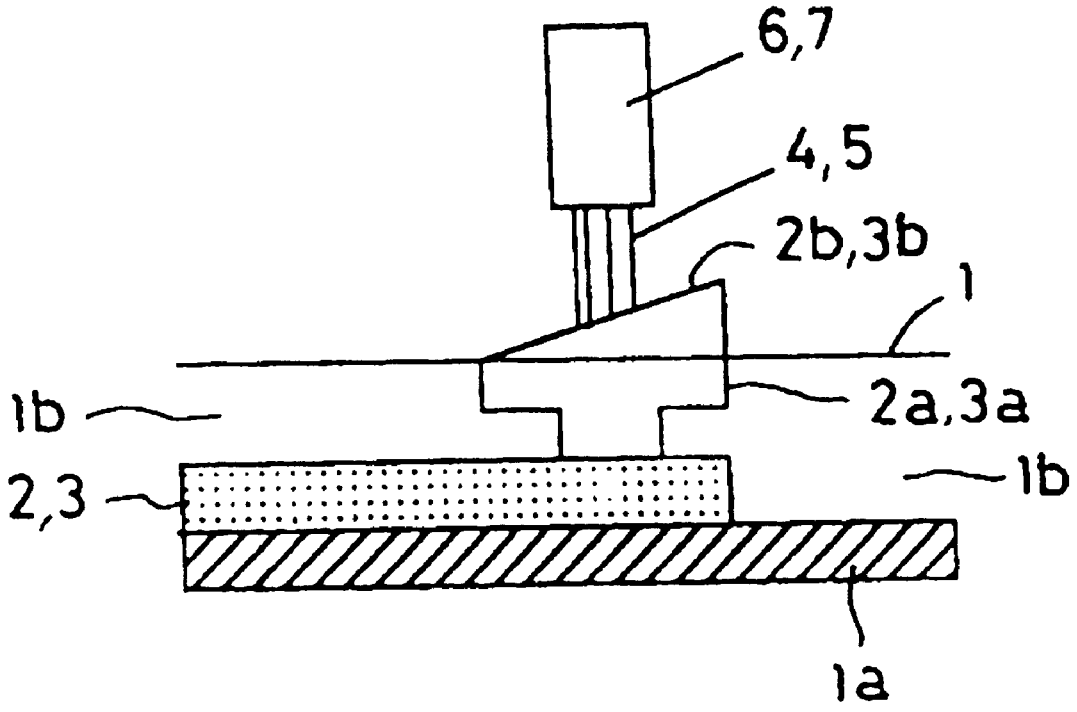
FIG. 6 is a partial section view showing a structure of the voltage receiving portion of the second embodiment of the sheet adhering conveying apparatus according to the present invention.
Figure 7A:
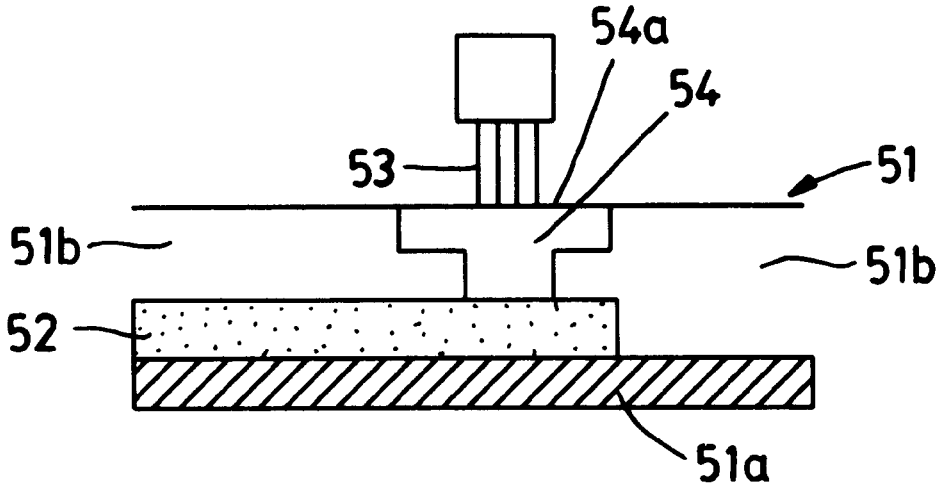
FIGS. 7(*a*) and 7(*b*) are illustrations showing an example of a conventional apparatus.
Figure 7B:
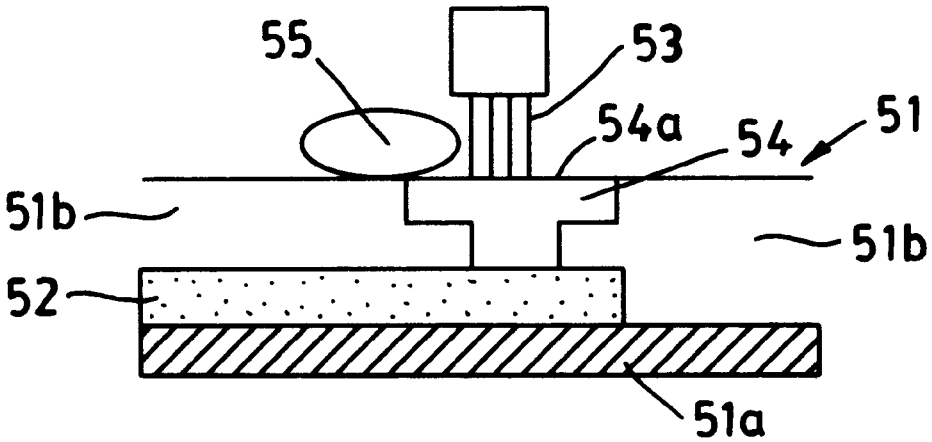

FIG. 1 is a plan view showing a structure of the sheet adhering conveying apparatus according to the present invention; FIG. 2 is a view when seen from the direction of A in FIG. 1; FIG. 3 is a sectioned view showing an essential portion of a structure of voltage receiving portions in the first embodiment of the sheet adhering conveying apparatus according to this invention; FIG. 4 is an illustration showing a situation of forming electrostatically adhering force produced between a pair of comb-shaped electrodes placed alternately to which the electrical potential different from each other is applied; FIG. 5 is a cross-sectional view showing a structure of the recording apparatus employing the sheet adhering conveying apparatus according to the present invention; and FIG. 6 is a partial section view showing a structure of a voltage receiving portion of the second embodiment of the sheet adhering conveying apparatus according to the present invention.

First, referring to FIGS. 1 to 5, the first embodiment of a sheet adhering conveying apparatus and a recording apparatus employing the sheet adhering conveying apparatus according to the present invention are described. FIG. 1 shows an endless conveyance belt for conveying a recording sheet P made of dielectrics such as papers or synthetic resins upon electrostatically adhering the sheet, and the belt is made of dielectric materials having electrically insulating characteristic by synthetic resins such as polyethylene.

Inside the conveyance belt 1, unitedly formed are an alternately placed pair of comb-shaped electrodes 2, 3 serving as the first and the second electrodes respectively to which electrical potentials different from each other are applied, and voltage receiving portions 2*a*, 3*a* electrically connected to respective comb-shaped electrodes 2, 3 placed on both sides of the conveyance belt 1 respectively. Each of the electrodes 2, 3 is in a shape of a rectangular slice and the electrodes are arranged in a width direction of the conveyance belt 1. Voltage receiving portions 2*a* of the first comb-shaped electrodes 2 and voltage receiving portions 3*a* of the second comb-shaped electrodes 3 are arranged on the right side of the moving conveyance belt 1 and on the left side of the conveyance belt 1, respectively.

As shown in FIG. 3 and FIG. 4, a base layer 1*a* of the conveyance belt 1 is formed below the comb-shaped electrode 2, 3 embedded in the conveyance belt 1*a*, and a surface layer 1*b* is formed above the comb-shaped electrodes 2, 3. Each comb-shaped electrode 2, 3 is made to provide high voltage of the electrical potential difference between the anodes and the cathodes, approximately several kilos of voltage, produced by a high voltage generating apparatus not shown here. There might be a case where the negative voltage is applied to the cathodes; however, in this embodiment, the first comb-shaped electrode 2 serves as the anode, and the second comb-shaped electrode 3 as the negative pole connected to ground electric potential.

As shown in FIG. 6, comb-shaped electrodes 2, 3 are arranged facing each other in a direction in the right angle with the rotating direction of the conveyance belt. Voltage receiving portions 2*a*, 3*a* having a longer width than that of the comb-shaped electrode 2, 3 in the rotating direction of the conveyance belt 1 and being electrically connected to respective comb-shaped electrodes 2, 3 are provided on both sides in a direction perpendicular to the rotating direction of the conveyance belt 1.

At least upper surfaces 2*b*, 3*b* of the voltage receiving portions 2*a*, 3*a* are projecting from the surface of the conveyance belt 1, and according to this embodiment, as shown in FIG. 2 and FIG. 3, the upper surfaces 2*b*, 3*b* of the voltage receiving portions 2*a*, 3*a* are formed with an upwardly convex surface.

Above the voltage receiving portions 2*a*, 3*a*, voltage supplying brushes 4, 5 for supplying voltage in contact with the upper surfaces 2*b*, 3*b* of the voltage receiving portions 2, 3 with a prescribed pressure are supported by support materials 6, 7. A high-voltage generating apparatus, not shown, applies a positive voltage to the comb-shaped electrodes 2 through the voltage supplying brushes 4, 5 as well as the voltage receiving portions 2*a*, 3*a*, and the comb-shaped electrodes 3 are connected to the ground potential.

A contacting portion of the voltage supplying brushes 4, 5 serving as voltage supplying means in contact with the voltage receiving portions 2*a*, 3*a* is formed having a downwardly convex shape corresponding to the upwardly convex surface of the upper surfaces 2*b*, 3*b* of the voltage receiving portions 2*a*, 3*a*.

Each comb-shaped electrode 2, 3 is formed to be protected in such a way of being sandwiched between a base layer 1*a* and a surface layer 1*b*. The volume resistivity of the base layer 1*a* and the surface layer 1*b* are $10^{15}$ to $10^{17}$ Ωcm and $10^{10}$ to $10^{14}$ Ωcm, respectively, and the layers are made of synthetic resins such as polyethylene or polycarbonate.

In addition, the voltage receiving portions 2*a*, 3*a* are made of a conductive synthetic resin, contacting carbons with volume resistivity of $10^{-14}$ to $10^{5}$ Ωcm Both the surface layer 1*b* and the upper surfaces 2*b*, 3*b* of the voltage receiving portions 2*a*, 3*a* are finished with a surface treatment such as fluororesin treatment, and since such treatment has good water repelling ability, ink droplets sprayed from recording heads 8Y, 8M, 8C, 8K may less likely remain on the voltage receiving portions 2*a*, 3*a*, thereby realizing good supply of voltage. Desired conductive materials for the voltage supplying brushes 4, 5 are those with volume resistivity of $10^{-4}$ to $10^{-5}$ Ωcm.

When a voltage is applied between the comb-shaped electrodes 2 and the comb-shaped electrodes 3, electric force is generated to form electric field lines as shown in FIG. 4. The potential difference between the comb-shaped electrodes 2, 3 produces an electrostatic adhering force in the upper part of the conveyance belt 1, resulting in adhering for conveying the recording sheet P.

According to this embodiment, because the volume resistivity [Ωcm] of the base layer 1*a* is set higher than that of the surface layer 1*b*, electric field lines produced between the comb-shaped electrodes 2 and the comb-shaped electrodes 3 are stronger on an upper side of the conveyance belt 1, so the adhering force for conveying the recording sheet P can be larger.

The voltage supplying brushes 4, 5 are set not to have a direct contact with the surface of the conveyance belt 1 but to contact with only the voltage receiving portions 2*a*, 3*a*. In this embodiment, as shown in FIG. 2, a spaced distance between the surface of the conveyance belt 1 and a nozzle formed at a lower end of recording heads 8Y, 8M, 8C, 8K serving as recording means, is set to 2 mm, and a height from the surface of the conveyance belt 1 to the apexes of the upper surfaces 2*b*, 3*b* of the voltage receiving portions 2*a*, 3*a* to which the voltage supplying brushes 4, 5 are contacting is set to 3 mm, therefore the apexes of the upper surfaces 2*b*, 3*b* of the voltage receiving portions 2*a*, 3*a* are higher than the position of the nozzle. As a result, the voltage supplying brushes 4, 5 have no contact with the conveyance belt 1, so stain or frictional wearing on the supplying brushes 4, 5 can be reduced, and the life of the brushes 4, 5 can be longer.

According to the above structure, ink droplets sprayed from the recording heads 8Y, 8M, 8C, 8K may not flow onto the voltage receiving portions 2*a*, 3*a* from the conveyance belt 1 since the voltage receiving portions 2*a*, 3*a* are projecting from the surface of the conveyance belt 1*a*, and therefore, supplying voltage by the voltage supplying brushes 4, 5 may be free from any trouble, and any corrosion of the brushes 4, 5 may not occur. Also, stains and frictional wearing of the voltage supplying brushes 4, 5 can be reduced because the voltage supplying brushes 4, 5 do not contact with the surface of the conveyance belt 1.

Because the upper surfaces 2*b*, 3*b* of the voltage receiving portions 2*a*, 3*a* have upwardly convex surfaces, even when ink droplets sprayed from the recording heads 8Y, 8M, 8C, 8K are scattered over the voltage receiving portions 2*a*, 3*a* of the comb-shaped electrodes 2, 3, the ink droplets are easily removed by their flowing down over the upwardly convex upper surfaces 2*b*, 3*b*. Consequently, supplying voltage by the voltage supplying brushes 4, 5 may not involve any trouble, and no corrosion of the brushes 4, 5 may occur.

With the structure where the contacting part of the voltage supplying brushes 4, 5 with the voltage receiving portions 2*a*, 3*a* is convexly structured corresponding to the upwardly convex upper surface of the voltage receiving portions 2*a*, 3*a*, the fitting of the voltage supplying brushes 4, 5 to the voltage receiving portions 2*a*, 3*a* is very suitable, and supplying voltage can be made satisfactorily.

Referring to FIG. 5, a structure of an inkjet recording apparatus having the sheet adhering conveying apparatus mentioned above is described. In FIG. 5, in a sheet supplying section shown, a pushing plate 21 stacking recording sheets P is pivotally movable around a rotation axis 21*a* connecting to a base 23, and it is pushed by a pushing plate spring 24 toward a supplying rotating body 22 which supplies the recording sheets P.

A separation pad 25 having a high frictional coefficient is placed on the pushing plate 21 to prevent more than one recording sheet P from being sent. At the opposite of the end of the pushing plate 21, a separation hook 26 is placed. A releasing cam (not shown) disengages the contact between the pushing plate 21 and the feeding rotating body 22.

During the standby situation, the releasing cam presses down the pushing plate 21, and therefore, contact between the pushing plate 21 and the feeding rotating body 22 is released. When a drive force from a conveying roller 27, while in this state, reaches to the supplying rotating body 22 as well as the releasing cam through gears or the like not shown, the releasing cam separates from the pushing plate 21, making the pushing plate 21 move up and contact to the recording sheet P. thereby starting feeding the recording sheet P upon picking up the recording sheet P along with the rotation of the feeding rotating body 22. The feeding rotating body 22 continues rotating until sending up the recording sheet P to the sheet conveying section. Numeral 28 is a feeding rotating body for manual feeding and sends a recording sheet P placed on a manual feeding tray 29 up to the sheet conveying section.

The sheet conveying section has the mentioned conveyance belt 1 for conveying the recording sheet P using electrostatic adherence as well as a paper edge (PE) sensor, not shown. The conveyance belt 1 is driven by a driving roller 30 and is tensioned by a conveying roller 27 as a driven roller and a pressure roller 31.

At a position opposite to the conveying roller 27, a pinch roller 33 driven rotatively by the conveyance belt 1 is placed to contact with the conveyance belt 1, and recording heads 8Y(Yellow), 8M(Magenta), 8C(Cyan), and 8K(Black) as recording means are arranged on a downstream side of the conveying roller 27 in the feeding direction of the recording sheet P.

The recording heads have a resolution of 600 DPI and are recording heads of a full-line type in which a plurality of nozzles is arranged in a direction perpendicular to the conveying direction of the recording sheet P. According to this embodiment, full-line type recording heads are used in which the nozzles are placed across the whole width of a recording area of the sheet.

Those recording heads can provide heat to inks with a heater or the like to produce film boiling in ink which makes the nozzles spray inks by pressure change created by growing and shrinking bubbles, thereby forming images on the recording sheet P.

A sheet tray section is constituted of a delivery roller 34 and a spur 35, and the recording sheet P with formed images is sandwiched between the delivery roller 34 and the spur 35 and delivered to a delivery tray 36.

The recording heads 8Y, 8M, 8C, 8K have fine orifices (liquid spraying openings), liquid passages, energy operating portions provided in respective liquid passages, and energy generating means for generating droplet forming energy to work on liquid in the energy operating portion.

As for the energy generating means for generating such energy, there are some recording methods such as a recording method using an electromechanical converter such as piezo elements, a recording method using energy generating means on which an electromagnetic wave such as a laser beam is radiated to make heating which operates to spray the droplets, a recording method using an energy generating means in which liquid is heated by an electrothermal converter such as a heat generating element having heat-generating resistors to spray liquid, or the like.

Among those methods, the recording head employed for the inkjet recording method to spray liquid by thermal energy can produce high resolution recordings because the orifices for forming spraying droplets upon spraying droplets for recording can be arrayed with a high density.

Among those recording heads, a recording head employing electrothermal converters as energy generating means is advantageous because the head is easier to be made compact, can fully utilize recent technological advancements in the semiconductor technology and merits on the IC technology and the micro fabrication technology whose reliability is remarkably improved, can easily make parts mount with high density, and can make the production cost reduced.

Although in the above mentioned embodiment, the inkjet recording method is employed as a recording means, it is further desirable to constitute the recording means such that the electrothermal converter is powered on corresponding to a recording signal and that ink is sprayed to make recordings from orifices by using the bubble growth and shrinkage created in the ink by film boiling in the ink produced by thermal energy applied from the electrothermal converter.

As far as the representative structures or principles concerned, it is also desirable to use fundamental principles, for example, as disclosed in specifications of U.S. Pat. Nos. 4,723,129 and 4,740,796.

Furthermore, the inkjet recording apparatus mentioned above can be a photocopier combined with a reader or a facsimile machine with a transmitting and receiving function in addition to the form as an image output terminal apparatus for information processing equipment such as computers or the like. The recording heads 8Y, 8M, 8C, 8K are not limited to ones for the line recording method, and can be used for a so-called serial recording method.

Referring to FIG. 6, a second embodiment of a sheet adhering conveying apparatus according to the invention is described next. The explanation of substantially the same structure as that in the first embodiment is omitted by using the same reference numbers.

In the embodiment, as shown in FIG. 6, at least the upper surfaces 2*b*, 3*b* of the voltage receiving portions 2*a*, 3*a* electrically connected to comb-shaped electrodes 2, 3 installed in the conveyance belt 1 are projecting from the surface of the conveyance belt 1. The upper surfaces 2*b*, 3*b* of the voltage receiving portions 2*a*, 3*a* are formed with an inclined plane inclined to a direction perpendicular to the rotating direction of the conveyance belt 1, and contacting portions of the voltage supplying brushes 4, 5 with the upper surfaces 2*b*, 3*b* of the voltage receiving portions 2*a*, 3*a* are formed in a form made of an inclined plane corresponding to the inclined plane of the upper surfaces 2*b*, 3*b*.

According to the above structure, even when the ink droplets sprayed from the recording heads 8Y, 8M, SC, 8K are spread over the voltage receiving portions 2*a*, 3*a* of the comb-shaped electrodes 2, 3, the ink droplets are easily removed from the voltage receiving portions 2*a*, 3*a* by flowing down over the inclined planes of the upper surfaces 2*b*, 3*b*, resulting in that supplying voltage by voltage supplying brushes 4, 5 as a voltage supplying means may not have a problem that any corrosion of the voltage receiving portions 2*a*, 3*a* or the voltage supplying brushes 4, 5 may occur.

Furthermore, since the contacting portions of the voltage supplying brushes 4, 5 with the voltage receiving portions 2*a*, 3*a* are structured to correspond to the inclined flat planes of the upper surfaces of the voltage receiving portions 2*a*, 3*a*, the voltage supplying brushes 4, 5 can fit desirably to the voltage receiving portions 2*a*, 3*a*, and supplying voltage can be satisfactorily made. Other structures are formed in substantially the same way as that of the first embodiment, so the same effects can be gained.

It is to be noted that although in the mentioned embodiment it is shown as an example that the upper surfaces 2*b*, 3*b* of the voltage receiving portions 2*a*, 3*a* are formed with inclined flat planes inclined in a direction perpendicular to the rotating direction of the conveyance belt 1, it is also possible to have flat planes, as inclined in other different directions, of the upper surfaces 2*b*, 3*b* of the voltage receiving portions 2*a*, 3*a*.

As far as the shape of the upper surfaces 2*b*, 3*b* of the voltage receiving portions 2*a*, 3*a* is convex or inclined and such that the ink droplets sprayed over the voltage receiving portions 2*a*, 3*a* can flow onto the conveyance belt 1, other various shapes can be used, and the shape is not limited to those in the above embodiments.

Further, the distance between the voltage receiving portions 2*a*, 3*a* and the conveyance belt 1 is not limited to 3 mm; any height can be used so far as the height can avoid ink flowing onto the belt. In addition, the resolution of the recording heads 8Y, 8M, 8C, 8K is not specifically limited to 600 DPI, and other resolutions may be used.

According to the first and second embodiments, the voltage receiving portion 2*a* of the first comb-shaped electrode 2 is set at the one edge of the conveyance belt 1, and the voltage receiving portion 3*a* of the second comb-shaped electrode 3 is set at the other edge of the conveyance belt 1. However, this invention is not limited to this structure, and it is possible to set both voltage receiving portions 2*a*, 3*a* of the comb-shaped electrodes 2, 3 at the same edge of the conveyance belt 1.

With this invention, since including the structure and the effect mentioned above, ink droplets sprayed from the inkjet recording heads may not flow onto the voltage receiving portion by way of the conveyance belt 1 because the voltage receiving portions of the comb-shaped electrodes are projecting from the surface of conveyance belt 1. Also, supplying voltage by a voltage supplying means may not have a trouble, or any corrosion of the voltage receiving portion or the voltage supplying means may not occur, so that the durability of the apparatus will be improved. The stain and frictional wearing can be reduced because the voltage supplying means does not contact with the surface of the conveyance belt.

In the case where the upper surface of the voltage receiving portion is formed of the upwardly convex surface or inclined flat plane, even when the ink droplets sprayed from inkjet recording heads are spread over the voltage receiving portions of the comb-shaped electrodes, the ink droplets can be removed because the droplets flow down over the upwardly convex surface or inclined flat plane. Therefore, supplying voltage by a voltage supplying means may not have a trouble, or any corrosion of the voltage receiving portion or the voltage supplying means may not occur.

Also, in the case where the contacting portion of the voltage supplying means contacting with the voltage receiving portion is formed with the shape corresponding to the upwardly convex surface or inclined flat plane of the upper surface of the voltage receiving portion, the voltage supplying means can fit suitably to the voltage receiving portion, and supplying voltage can be satisfactorily made.

What is claimed is:

1. A sheet adhering conveying apparatus comprising:

a conveyance belt for holding and conveying a sheet;

a plurality of electrodes embedded in the conveyance belt, each electrode having a voltage receiving portion formed to project above a surface of the conveyance belt; and voltage supplying means for supplying a voltage to the voltage receiving portions of the electrodes.

2. The sheet adhering conveying apparatus according to claim 1, wherein the electrodes are constituted of first and second rectangular strip shaped electrodes to which electrical potential different from each other are applied, and wherein a plurality of the first and second electrodes are arranged alternately in a comb-like shape in a direction intersecting with a moving direction of the conveyance belt.

3. The sheet adhering conveying apparatus according to claim 1, wherein the voltage receiving portion of the electrodes has a convexly curving surface.

4. The sheet adhering conveying apparatus according to claim 1, wherein the voltage receiving portion of the electrodes has an inclined plane surface.

5. The sheet adhering conveying apparatus according to claim 1, claim 3 or claim 4, wherein the voltage supplying means has a form fitting in a form of the voltage receiving portion of the electrodes.

6. The sheet adhering conveying apparatus according to claim 5, wherein the voltage supplying means for supplying voltage is a voltage supplying brush.

7. A recording apparatus comprising:

a sheet adhering conveying apparatus having:

a conveyance belt for holding and conveying a sheet;

multiple electrodes which are placed inside the conveyance belt and each of which have a voltage receiving portion formed to project above the surface of the conveyance belt; and means for supplying voltage to the voltage receiving portions of the electrodes; and recording means positioned opposite to the conveyance belt for recording on the sheet.

8. The recording apparatus according to claim 7, wherein the recording means makes a recording on the sheet by discharging ink droplets from orifices.

9. The recording apparatus according to claim 8, wherein multiple recording means are placed along a moving direction of the conveyance belt, and wherein the orifices are placed in line in a direction perpendicular to the moving direction of the conveyance belt.

10. The recording apparatus according to claim 7, wherein the recording means is a full-line type recording head in which a plurality of recording elements are placed over the whole width of a recording area of the sheet.

11. The recording apparatus according to claim 7 to claim 9 or claim 10, wherein the recording means discharges ink from the orifice utilizing film boiling occurring in the ink by thermal energy applied by an electric thermal converter.

* * * * *

UNITED STATES PATENT AND TRADEMARK OFFICE

CERTIFICATE OF CORRECTION

PATENT NO. : 6,164,761
DATED : December 26, 2000
INVENTOR(S) : Numata

It is certified that error appears in the above-identified patent and that said Letters Patent is hereby corrected as shown below:

Column 4,
Line 47, "$10^5\Omega$cm Both" should read -- $10^5\Omega$cm. Both --.

Column 6,
Line 5, "to" should be deleted.

Column 7,
Line 44, "8Y, 8M, SC, 8K" should read -- 8Y, 8M, 8C, 8K --.

Column 10,
Line 20, "claim 7 to claim" should read -- claim 7, claim --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*